United States Patent [19]

Blake et al.

[11] 4,186,067

[45] Jan. 29, 1980

[54] ELECTROLYTIC RECOVERY OF SILVER FROM PHOTOGRAPHIC BLEACH-FIX BATHS

[75] Inventors: Colin C. Blake, Rochford; Ivan C. Payne, Brentwood, both of England

[73] Assignee: Ciba-Geigy Aktiengesellschaft, Basel, Switzerland

[21] Appl. No.: 934,302

[22] Filed: Aug. 17, 1978

Related U.S. Application Data

[63] Continuation-in-part of Ser. No. 586,836, Jun. 13, 1975, abandoned.

[30] Foreign Application Priority Data

Jun. 26, 1974 [GB] United Kingdom ..... 28330/74

[51] Int. Cl.[2] ..... C25C 1/20; C25C 7/00; C25C 7/02

[52] U.S. Cl. ..... 204/109; 204/195 R; 204/195 F

[58] Field of Search ..... 204/195 R, 195 F, 109

[56] References Cited

U.S. PATENT DOCUMENTS

| | | | |
|---|---|---|---|
| 3,051,631 | 8/1962 | Harbin, Jr. et al. | 204/195 R |
| 3,179,581 | 4/1965 | Lewin et al. | 204/195 R |
| 3,649,509 | 3/1972 | Morawetz et al. | 204/275 |
| 4,036,715 | 7/1977 | Baden et al. | 204/109 |

*Primary Examiner*—R. L. Andrews
*Attorney, Agent, or Firm*—Sprung, Felfe, Horn, Lynch & Kramer

[57] ABSTRACT

This invention relates to the recovering of metallic silver from photographical bleach-fix baths. An electric current is passed through a bleach-fix solution containing silver ions and ferric ions, which solution has been brought to a predetermined redox potential by the addition of a reducing agent. The cathode is of the type wherein reduced silver ions can deposit thereon as metallic silver. The redox potential of the electrolyte solution is continuously monitored and a reducing agent is added automatically when the redox potential rises above a predetermined level. When the redox potential drops below a predetermined level the addition of the reducing agent is automatically stopped.

7 Claims, 2 Drawing Figures

ELECTROLYTIC RECOVERY OF SILVER FROM PHOTOGRAPHIC BLEACH-FIX BATHS

This is a continuation-in-part application of copending patent application Ser. No. 586,836, filed June 13, 1975 (now abandoned).

In the conventional processing of colour photographic material a developable silver salt image is developed with an aromatic primary amino developing agent of the para-phenylene diamine type (a so-called "colour developer") in the presence of a compound (a so-called "colour coupler") which will combine with the oxidation products of the colour developer to form an azomethine or quinone-imine dye. The dye is thus formed in situ with the developed silver image. Subsequently the product must be bleach-fix bath thereby to remove silver and any residual silver halide or other silver salt, leaving in the product only the dye image.

The use of a combined bleach-fix bath is preferable because it results in a reduction of the processing time and of the processing equipment required. Normally a bleach-fix bath comprises a mild oxidising agent for example a ferric-chelate complex together with a silver halide solvent or fixing agent for example a water-soluble thiosulphate or a water-soluble thiocyanate.

It is usually required to recover the silver from spent bleach-fix baths i.e. baths which contain a high dissolved silver content and wherein the silver-bleaching capability of the bath has become relatively reduced. However even in spent bleach-fix baths there is always a proportion of ferric ions and when a solution containing ferric ions is electrolysed the ferric ion becomes a ferrous ion at the cathode.

This reaction occurs at the same time as the silver ions in the solution are being deposited on the cathode as metallic silver. The conversion of ferric ions to ferrous ion proceeds at a faster rate than the deposition of silver and thus when a spent bleach-fix bath is electrolysed the beginning part of the process is occupied by reducing ferric ions to ferrous ions. This is both a waste of time and of electricity. However the ferric ions may be reduced to ferrous ions before the electrolysis of the spent bleach-fix solution is commenced by adding to the bleach-fix solution a reducing agent. Nevertheless it is required that the amount of reducing agent added to spent bleach-fix solutions should be carefully controlled because too little reducing agent results in not all the ferric ions being reduced to ferrous ions, while on the other hand too much reducing agent causes the silver in solution to precipitate either as elemental silver or as silver sulphide. A further complication is that ferric ions are continuously being regenerated in a spent bleach-fix bath while being electrolysed either by aerial oxidation or anodic oxidation.

A method has now been found of recovering silver electrolytically from a spent bleach-fix bath while keeping the amount of the ferric ions in the solution at a minimum during the electrolysis.

According to the present invention there is provided a method of recovering metallic silver from bleach-fix baths which comprises passing an electric current through an electrolytic cell wherein the electrolyte is a bleach-fix solution containing silver ions and ferric ions, which solution has been brought to a predetermined redox potential by the addition of a reducing agent, and wherein the cathode is of the type wherein reduced silver ions can deposit thereon as metallic silver, continuously monitoring the redox potential of the electrolyte and adding automatically a reducing agent either in aqueous solution or in the form of a solid powder to the electrolyte when the redox potential rises above a predetermined level and stopping automatically the addition of the reducing agent when the redox potential drops below a predetermined level as a consequence of the addition of the reducing agent to the electrolyte.

The bleach-fix solution containing silver and ferric ions is brought by the addition of a reducing agent to a (predetermined) redox potential which indicates that substantially complete reduction of the ferric ions to ferrous ions has occurred but at which no silver ions can be reduced to silver metal.

Reducing agent is automatically added as an aqueous solution or in the form of a solid power to the electrolyte when the redox potential rises above a level which indicates the reappearance of ferric ions and the addition of reducing agent is automatically stopped when the redox potential drops below a level which indicates that substantially complete reduction of the ferric ions to ferrous ions has occurred but at which no silver ions can be reduced to silver metal.

Thus in the process of the present invention the electrolytic recovery of silver is carried out under such conditions that the ferric ions are kept to a minimum throughout. However the reducing conditions are not such that silver ions are precipitated as a silver sludge. This would occur if a large excess of reducing agent were added either initially in the process or during the course of the process.

The preferred reducing agent for use in the process of the present invention is a dithionite and the most preferred dithionite is sodium dithionite. Other suitable reducing agents are hydrazine, hydroxylamine, alkali metal phosphites, alkali metal hypophosphites, alkali metal borohydrides, ascorbic acid and sulphinic acid.

Preferably the redox potential of the electrolyte is monitored continuously by providing in the electrolytic cell, immersed in the electrolyte, a platinum plus reference electrode connected to a means to indicate the redox potential.

Most preferably the reference electrode is a saturated calomel electrode and the means to indicate the redox potential is a milli-volt meter. Using such combination a reading of −300 mv on the milli-volt meter indicates that the redox potential of the electrolyte is such that there are substantially no ferric ions present in the solution.

The desirable range of redox potentials at which to carry out the process of the present invention depends on the electrodes used and also on the reducing agent used. The actual reducing agent used has some slight effect on the requisite redox potential range because the reduction is a very complex reaction and some side reactions also occur. Also the addition of dithionite to the electrolysis solution alters the pH of the solution and this alteration in th pH also affects the requisite redox potential range. When a dithionite is used as the reducing agent and the electrode pair comprises a platinum indicator electrode and a saturated calomel reference electrode and the potential is measured in millivolts then the desired redox potential range is from −250 mV (which is equivalent to substantially no ferric ions) to −320 mV (above which some reduction of silver ions to silver sludge occurs). Preferably using this system the redox potential should be brought to and maintained as close to −300 mV as possible. When dithionite is used as the reducing agent and the electrode pair comprises a silver indicator electrode and a silver chloride reference electrode and the potential is measured in millivolts then the desired redox potential range is from −206 mV (which is equivalent to substantially no ferric ions) to −276 mV (above which some reduction of silver ions to silver sludge occurs). Preferably using this system the redox potential should be brought to and maintained as close to −256 mV as possible.

The above quoted ranges are easily obtained by titrating samples of bleach-fix solution with the reducing agent to be used whilst monitoring the redox potential.

A convenient means for automatically adding a solution of the reducing agent to the electrolyte when the redox potential falls below a predetermined level comprises a potentiostat which is connected to the means to measure the redox potential, which is conveniently a milli-volt meter, there being connected to the potentiostat a solenoid which is so located to be able to actuate a relay which makes or breaks an electrical circuit connected to a pump which pumps the solution of the reducing agent into the electrolyte. Most preferably the pumping means is a peristaltic pump. Suitably a 10 to 30% by weight solution of reducing agent in water is employed as the reducing agent.

Similar means may be employed for automatically feeding solid reducing agent to the electrolyte. In this case the means also comprises a potentiostat which is connected to the means to measure the redox potential, which is conveniently a milli-volt meter, there being connected to the potentiostat a solenoid which is so located to be able to actuate a relay which makes or breaks an electrical circuit connected to an electric motor which causes equipment for dispensing solid reducing agent into the electrolyte to operate.

According to another aspect of the present invention there is provided apparatus for recovering metallic silver from bleach-fix baths which comprises an electrolytic cell having a cathode of the type on which reduced silver ions can deposit, a platinum plus calomel pair of electrodes for measuring the redox potential of the bleach-fix solution, a milli-volt meter connected to the platinum plus calomel pair of electrodes for indicating the redox potential of the bleach-fix solution in milli-volts, a potentiostat connected to the milli-volt meter and to which is connected a solenoid, together with an electrical circuit which comprises a relay which can be actuated by the said solenoid, a source of electric voltage and a pump which operates continuously when the said circuit is made but stops when the circuit is broken, a tank for holding an aqueous solution of a reducing agent and supply means joining the tank to the said pump and the said pump to the electrolytic cell.

Preferably the pump is a peristaltic pump.

In another embodiment of this aspect of the present invention there is provided apparatus for recovering metallic silver from bleach-fix baths which comprises an electrolytic cell having a cathode of the type on which reduced silver ions can deposit a platinum plus calomel pair of electrodes for measuring the redox potential of the bleach-fix solution, a milli-volt meter connected to the platinum plus calomel pair of electrodes, a potentiostat connected to the milli-volt meter and to which is connected a solenoid, together with an electrical circuit which comprises a relay which can be actuated by the said solenoid, a source of electric voltage and equipment for dispensing solid reducing agent into the electrolytic cell which operates continuously when the said circuit is made but stops when the circuit is broken.

Preferably the equipment which dispenses solid reducing agent into the electrolytic cell is a hopper for holding the solid reducing agent and connected therewith an electronically driven archimedian screw which when driven continuously transfers solid reducing agent from the hopper to the electrolytic cell.

In practice the preferred reducing agent for use with the apparatus using either the solid reducing agent or the aqueous solution of reducing agent is sodium dithionate.

The accompanying drawings will serve to illustrate the apparatus of the present invention and how such apparatus is used to carry out the method of the present invention.

Figure 1:
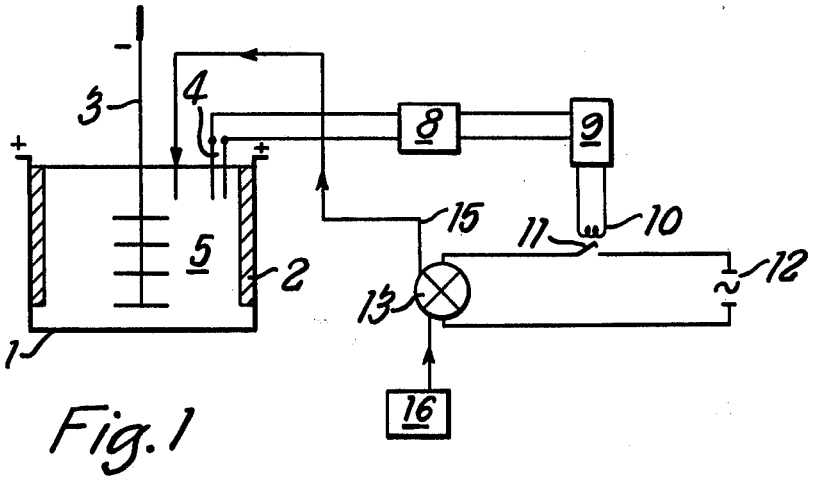
FIG. 1 is a schematic representation of the embodiment of the apparatus of the present invention wherein an aqueous solution of reducing agent is pumped into the electrolytic cell.

In FIG. 1 an electrolytic cell 1 has at its outside walls an anode 2 and there is suspended in the cell 1 a rotating cathode 3 and a pair of electrodes 4 which measure the redox potential of the electrolyte 5 which is contained in the cell 1. The electrolyte 5 is a spent bleach-fix solution which contains ferric ions and dissolved silver ions. The pair of electrodes 4 comprises a platinum electrode and a saturated calomel reference electrode to which pair is connected a mv meter 8. To the mv meter 8 is connected a potentiostat 9 and to the potentiostat 9, which is maintained at 90 v, a solenoid 10. Below the solenoid 10 is a relay 11 which is activated by the solenoid 10 to close an electric circuit which comprises a source of AC voltage 12 and a peristaltic pump 13.

To the peristaltic pump 13 is connected by means of a delivery tube 15 a tank of sodium dithionite solution 16. The other end of the delivery tube 15 leads into the electrolytic cell.

To commence recovering silver a quantity of spent bleach-fix solution 5 is fed into the electrolytic cell 1 there being sufficient to cover partially at least the pair of electrodes 4. An electric current (from a source not shown) is then passed through the electrolytic cell and the redox potential of the solution is indicated on the mv meter 8. As ferric ions will be present in the spent bleach-fix solution the redox potential will be above −300 mv and thus the relay 11 will be caused to be closed by the solenoid 10 which is connected to the potentiostat 9. This will cause the peristaltic pump to pump the solution of dithionite contained in the tank 16 into the electrolytic cell 1 until the redox potential falls to −300 mv. As soon as this happens the pump 13 is switched off. At this stage virtually all the ferric ions will have been converted to ferrous ions and the electric current passing through the electrolysis cell will cause dissolved silver in the electrolyte 5 to plate-out on the rotating cathode 3.

If the redox potential rises due to aerial oxidation of the ferrous ion to ferric ion or the anodic oxidation of ferrous ion to ferric ion takes place then the redox potential of the system will rise causing more sodium dithionite solution to be pumped into the electrolysis cell until the redox potential falls to −300 mv.

Figure 2:
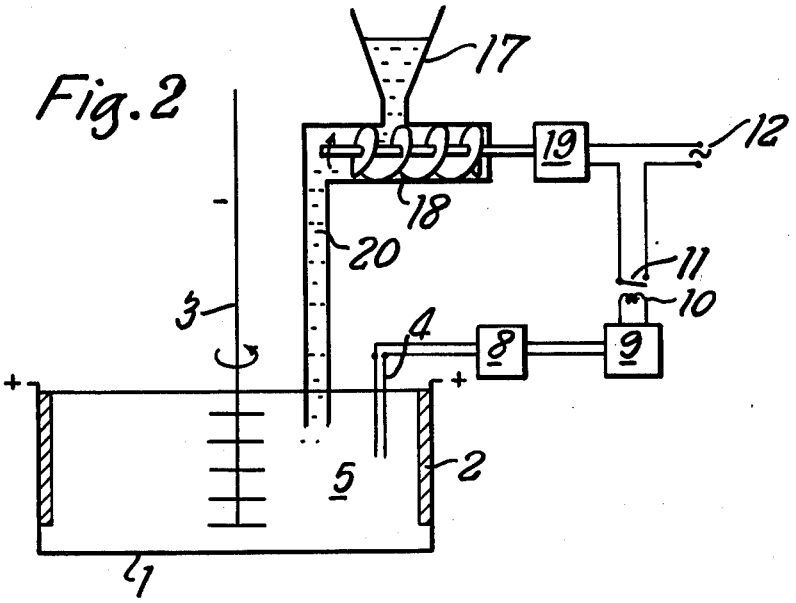
FIG. 2 is a schematic representation of the embodiment of the apparatus of the present invention wherein solid reducing agent is fed into the electrolytic cell.

In FIG. 2 there is shown an alternative embodiment wherein solid reducing agent is fed into the electrolytic cell. Most of the parts of the apparatus are the same as the parts of FIG. 1 and thus are designated with the same number.

In the FIG. 2 an electrolytic cell 1 has at its outside walls an anode 2 and there is suspended in the cell 1 a rotating cathode 3 and a pair of electrodes 4 which measure the redox potential of the electrolyte 5 which is contained in the cell 1. The electrolyte 5 is a spent bleach-fix solution which contains ferric ions and dissolved silver ions. The pair of electrodes 4 comprises a platinum electrode and a saturated calomel reference electrode to which pair is connected a mv meter 8. To the mv meter 8 is connected a potentiostat 9 and to the potentiostat 9, which is maintained at 90 v, a solenoid 10. Below the solenoid is a relay 11 which is activated by the solenoid 10 to close an electric circuit which comprises a source of AC voltage 12 and a electric motor 19.

A hopper 17 which contain solid sodium dithionite powder is located above an Archimedian screw 18. This screw is driven by the electric motor 19. When the screw is driven the solid sodium dithionite is removed from the hopper 17 and driven down the ducting 20 from which it falls into the electrolytic cell 1 located therebeneath.

To commence recovering silver a quantity of spent bleach-fix solution 5 is fed into the electrolytic cell 1 there being sufficient to cover partially at least the pair of electrodes 4. An electric current (from a source not shown) is then passed through the electrolytic cell and the redox potential of the solution is indicated on the mv meter 8. As ferric ions will be present in the spent bleach-fix solution the redox potential will be above −300 mv and thus the relay 11 will be caused to be closed by the solenoid 10 which is connected to the potentiostat 9. This will cause the electric motor 19 to actuate the Archimedian screw 18 and feed the sodium dithionite contained in the hopper 17 into the electrolytic cell 1 until the redox potential falls to −300 mv. As soon as this happens the motor 19 is switched off. At this stage virtually all the ferric ions will have been converted to ferrous ions and the electric current passing through the electrolytic cell will cause dissolved silver in the electrolyte 5 to plate-out on the rotating cathode 3.

If the redox potential rises due to aerial oxidation of the ferrous ion to ferric ion or the anodic oxidation of ferrous ion to ferric ion takes place then the redox potential of the system will rise causing more solid sodium dithionite to be fed into the electrolytic cell until the redox potential falls to −300 mv.

EXAMPLE

Method 1. Comparative method not according to the present invention

A bleach-fix of the following formulation was prepared.

| | |
|---|---|
| Ferric ammonium EDTA | 0.1 Moles |
| Ammonium thiosulphate | 150 gm |
| Sodium sulphite | 15 gm |
| Water to | 1 litre |
| pH 7.20 | |

Silver bromide was added to the solution to give a silver ion concentration of 5.0 g per liter. This bleach-fix solution simulates a spent bleach-fix solution containing a high silver ion concentration.

The redox potential of a platinum indicator electrode immersed in this solution was −100 mv when connected to a saturated calomel reference electrode.

Seventy liters of this solution were electrolysed in an electrolysis cell employing a rotating stainless steel cathode and a carbon anode. After electrolysing the solution for 2 hours at a current of 10 amps the silver concentration was reduced to 4.9 g per liter. This represented a current efficiency of 8.7%. On electrolysing the solution for a further nine hours the redox potential of the solution decreased to −190 mv and the current efficiency of silver plating rose to 15%. Further electrolysis produced no change in efficiency or redox potential.

Method 2. Comparative method not according to the present invention

70 Liters of the bleach-fix solution as described above was reduced by the addition of 3.67 liters of 20% solution of sodium dithionite until the redox potential had decreased to −300 mv. On electrolysis of the solution for one hour the current efficiency of silver plating was found to be 100%. However on continued electrolysis the efficiency eventually fell to 15% and the redox potential rose to −190 mv. The current of 10 amps had to be passed for about 24 hours before the silver concentration was reduced to 0.5 g per liter.

Method 3. According to the present invention

70 Liters of the bleach-fix solution as described above was reduced by the addition of 3.67 liters of 20% sodium dithionite solution until the redox potential fell to −300 mv. The solution was electrolysed as described above but the redox potential of the solution was maintained at −300 mv by the addition of sodium dithionite solution using the method of the present invention. The current efficiency of silver plating was maintained at 100% until the silver concentration was reduced to 0.5 gm/liter which took only 8 hours.

Method 2 shows the advantage to be gained by adding sufficient reducing agent to the spent bleach-fix solution to bring the redox potential to a predetermined figure.

Method 3 shows the added advantage to be gained by maintaining the redox potential at this predetermined figure.

What we claim is:

1. A method of recovering metallic silver from bleach-fix baths which comprises passing an electric current through an electrolytic cell wherein the electrolyte is a bleach-fix solution containing silver ions and ferric ions, which solution has been brought by the addition of a reducing agent to a redox potential which indicates that substantially complete reduction of the ferric ions to ferrous ions has occurred but at which no silver ions can be reduced to silver metal, and wherein reduced silver ions can deposit on the cathode as metallic silver, continuously monitoring the redox potential of the electrolyte and adding automatically a reducing agent to the electrolyte when the redox potential rises above a level which indicates the reappearance of ferric ions and stopping automatically the addition of the reducing agent when the redox potential drops below a level which indicates that substantially complete reduction of the ferric ions to ferrous ions has occurred but at which no silver ions can be reduced to silver metal as a consequence of the addition of the reducing agent to the electrolyte.

2. A method according to claim 1 wherein the redox potential of the electrolyte is monitored continuously by providing in the electrolytic cell, immersed in the electrolyte, a platinum plus reference electrode connected to a means to indicate the redox potential.

3. A method according to claim 2 wherein the reference electrode is a saturated calomel electrode and the means to indicate the redox potential is a milli-volt meter.

4. A method according to claim 3 wherein the redox potential is maintained at between −250 mV and −320 mV.

5. A method according to claim 4 wherein the redox potential is maintained as close to −300 mV as possible.

6. A method according to claim 1 wherein the reducing agent is a dithionite.

7. A method according to claim 6 wherein the dithionite is sodium dithionite.

* * * * *

UNITED STATES PATENT AND TRADEMARK OFFICE

CERTIFICATE OF CORRECTION

PATENT NO. : 4,186,067

DATED : January 29, 1980

INVENTOR(S) : Colin Charles Blake et al

It is certified that error appears in the above-identified patent and that said Letters Patent are hereby corrected as shown below:

Column 1, line 17, after "be" insert "treated with a bleach bath and a fixing bath or a combined".

Column 2, line 58, "th" should be "the".

Column 5, line 19, "a" , second occurrence, should be -- an --.

Signed and Sealed this

*Twenty-seventh* Day of *May 1980*

[SEAL]

*Attest:*

SIDNEY A. DIAMOND

*Attesting Officer*

*Commissioner of Patents and Trademarks*